US006869004B2

(12) United States Patent
Priest et al.

(10) Patent No.: US 6,869,004 B2
(45) Date of Patent: Mar. 22, 2005

(54) HIGH-SPEED FIBER FEED ASSEMBLY

(75) Inventors: James R. Priest, Nashport, OH (US); Frederick R. Vees, New Braunfels, TX (US); Christopher S. Garrett, Seguin, TX (US); David V. Stotler, Newark, OH (US)

(73) Assignee: Neptco JV LLC, Pawtucket, RI (US)

( * ) Notice: Subject to any disclaimer, the term of this patent is extended or adjusted under 35 U.S.C. 154(b) by 0 days.

(21) Appl. No.: 10/196,492

(22) Filed: Jul. 16, 2002

(65) Prior Publication Data

US 2004/0011843 A1 Jan. 22, 2004

(51) Int. Cl.[7] ..... B65H 23/08
(52) U.S. Cl. ..... 226/195
(58) Field of Search ..... 242/566, 128, 242/131, 131.1, 615.3, 615.11, 419.7; 226/118.2, 195

(56) References Cited

U.S. PATENT DOCUMENTS 1,956,631 A * 5/1934 Snyder ..... 242/128
2,048,511 A * 7/1936 Newton ..... 242/128
2,581,142 A * 1/1952 Rea ..... 242/154
2,686,018 A * 8/1954 Courtney ..... 242/128
3,282,304 A * 11/1966 Coleman ..... 242/566
3,568,949 A * 3/1971 Riha et al. ..... 242/129.8
4,186,896 A * 2/1980 Brandenberger et al. ... 242/131
4,471,917 A * 9/1984 Whisnant ..... 242/131.1
4,944,077 A 7/1990 Bollen
5,273,614 A 12/1993 Grimshaw et al.
5,639,036 A 6/1997 Flamm
6,045,023 A * 4/2000 Michard ..... 242/131
6,182,475 B1 2/2001 Lee
6,511,011 B2 * 1/2003 Zeller et al. ..... 242/131.1

* cited by examiner

*Primary Examiner*—William A. Rivera
(74) *Attorney, Agent, or Firm*—Mintz, Levin, Gohn, Ferris, Glovsky and Popeo, P.C.

(57) ABSTRACT

The fiber feed assembly includes one or more dampening bars arranged between a fiber source and an intake assembly that guides the fiber into an elongated feed tube through which the fiber is transferred for additional processing. The spacing and orientation of the dampening bar(s) relative to both the fiber source and the intake assembly may adjusted to control the fiber tension and remove fiber loops before the fiber enters the feed tube to reduce fiber breakage and machine downtime.

42 Claims, 7 Drawing Sheets

HIGH-SPEED FIBER FEED ASSEMBLY

CROSS-REFERENCE TO RELATED APPLICATIONS

There are no previously filed copending nonprovisional applications or international applications designating the United States of America from which priority is claimed for this application or other related applications to be cross-referenced in this application.

STATEMENT REGARDING FEDERAL SPONSORSHIP

None of the work leading to the present invention was performed under federally sponsored research and development.

TECHNICAL FIELD AND INDUSTRIAL APPLICABILITY OF THE INVENTION

This invention relates to an improved apparatus for the high-speed feeding of fiber materials from balls, doffs, cakes or other windings into one or more machines for further processing, and particularly for the high-speed feeding of continuous fibers of glass or synthetic materials.

BACKGROUND OF THE INVENTION

A common practice during the production of fiber products is to collect and wind strands of filaments onto a carrier to produce a fiber bundle that may be referred to as a ball, winding, package, cake or doff. These fiber bundles are then used to store, transport and supply fiber linearly into processes such as roving, rewinding, braiding, twisting, weaving, plying, knitting, chopping, pultrusion, filament winding, prepregging, wire coating or cabling for the production of products such as chopped strand mat, yarn wound onto bobbins, multi-end rovings or fabrics or other materials. Typically, a number of these fiber bundles are arranged in a creel or other assembly with individual fibers then being drawn from the separate bundles and passed either singly or in combination into one or more subsequent processes.

In many instances, it is helpful to adjust the tension of the fiber as it exits the feed tube to within a desired range, both to control the tension entering any subsequent processing and to provide a generally uniform tension for a plurality of fibers exiting various feed tubes. Winding operations in particular benefit from the use of a tensioning device between the feed tube and the winder to maintain an even tension in the fiber. Although a variety of tensioner designs are available, a spring tensioner capable of applying a uniform tension as the fiber passes at high speed and does not damage the strand even at high tension levels is preferred. Depending on the application, however, other types of tensioners, including post and disc, breaker bars/alligator clips, electromagnetic breaking/tensioning devices and ball-in-tube tensioners, could also be used in conjunction with the basic feed assembly to perform the desired tensioning.

As will be appreciated, the rate at which the final product may be produced is limited, at least in part, by the rate at which the fiber can be drawn from the creel and supplied to the desired manufacturing operation in a safe and sustainable manner. Prior art techniques that have been employed to control and guide the fiber as it is withdrawn from the creel include ring-shaped guides, eyelets and rollers manufactured from various ceramic and metallic materials. Guides fashioned from metals, such as steel, that are subject to corrosion are frequently coated with a layer of polished nickel or chrome to reduce or prevent corrosion of the guide surface and reduce the damage to the fiber as it is drawn through or across the guide. For instance, U.S. Pat. No. 5,273,614 to Grimshaw et al. discloses a particular construction for redirect rollers for guiding spaced tows. U.S. Pat. No. 4,944,077 to Bollen provides a method of reducing the air friction of yarns drawn from a bobbin at high speed in which a region of accelerated air surrounds the yarn. U.S. Pat. No. 6,182,475 to Lee provides yet another yarn guiding device for feeding yarn from a creel to a knitting needle utilizing a yarn guiding assembly constructed from a combination of zirconium oxide and yttrium oxide. Other work has been directed to modifying the creel itself. For example U.S. Pat. No. 5,639,036 to Flamm provides a textile machine in which the creel is pivotably supported on a pivot shaft with the motion of the shaft and the creel being controlled with an electric motor and a transmission belt unit.

It has been the inventors' experience, however, that those systems that include open frame assemblies remain susceptible to wrapping and binding of the fiber as the fiber feed speed increases. When the terminal operation is capable of accepting and using fiber at higher rates, the reduced fiber feed speed directly limits the productivity of the entire operation. Similarly, downtime resulting from fiber breaks and risk to operators presented by flailing ends of broken fibers further compromise efficiency and safety of the operation. The present invention was developed in order to address these limitations and safety issues and thereby allow improved high-speed operation of fiber feed operations.

SUMMARY OF THE INVENTION

The present invention relates to an improved high-speed fiber assembly that includes one or more dampening bars, an intake assembly, and feed tubes for transferring one or more fibers from an intermediate winding into an assembly for additional processing which may include operations such as roving, rewinding, braiding, twisting, weaving, plying, knitting, chopping, pultrusion, filament winding, prepregging, wire coating, cabling, tensioning or beaming. The configuration of the claimed assembly allows the fiber to be consumed at draw speeds in excess of 1500 meters/minute while reducing the tendency of the fiber to wrap around feed assembly components. By maintaining and controlling a generally free flow of the fiber, the present invention allows increased run speed, reduced downtime resulting from fiber breaks and improved operator safety. The present invention is suitable for use with a wide number of fibers including polymer fibers such as aramids, polyesters, nylons, polycarbonates (PC), polyethylenes (PE), polypropylenes (PP), polybutylene terephalate (PBT), polyethylene terephalate (PET) and polyphenylenebenzobisoxazole, carbon and metal fibers including steel and copper, various types of glass fibers such as E, ECR, S, C and D type glass fibers, and natural fibers such as jute, hemp, cotton and flax.

DETAILED DESCRIPTION AND PREFERRED EMBODIMENTS OF THE INVENTION

The present invention comprises an improved high-speed fiber assembly that includes a dampening assembly comprising one or more dampening bars, an intake assembly, and feed tubes for transferring one or more fibers from an initial winding into an assembly for conducting additional processing such as roving, rewinding, braiding, twisting, weaving, plying, knitting, chopping, pultrusion, filament winding, prepregging, wire coating, cabling, tensioning or beaming.

Figure 1:
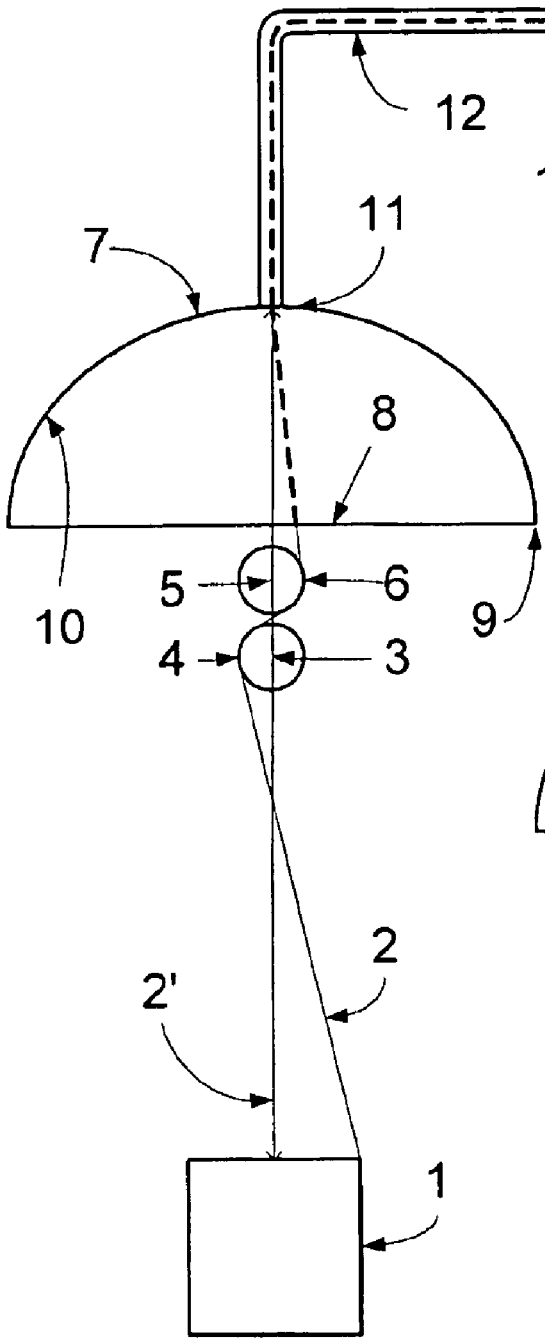
FIG. 1 illustrates the basic components of the claimed apparatus including a fiber source, a dampening bar assembly, an intake housing and a feed tube.

As illustrated in FIG. 1, the basic assembly comprises a fiber source 1, typically a winding or a doff provided in a creel or on a pallet, from which a fiber 2 is unwound for use in another process. As used herein, the term fiber is also intended to encompass tows and rovings that are configured to be unwound from an intermediate source for use in an additional operation. The fiber 2 is drawn over a dampening bar assembly comprising a first dampening bar 3 where it contacts a portion of the surface 4 of the dampening bar, the contacted portion preferably providing a smooth, durable surface that does not tend to damage or fuzz the fiber and does not suffer undue damage as the fiber is drawn across it at high speeds. After passing over the first dampening bar 3, the fiber is drawn over a second dampening bar 5 where it contacts a portion of the surface 6 of the second dampening bar, the contacted portion preferably providing a smooth, durable surface that does not tend to damage or fuzz the fiber and does not suffer undue damage as the fiber is drawn across it at high speeds.

After passing over dampening bar 5, the fiber 2 is drawn into an intake housing 7 which provides a large opening 8 defined by a peripheral edge 9 into a cavity that contains and guides the fiber 2 until it exits the intake housing 7 through a small rear opening 11 and enters the feed tube 12. The fiber continues through the feed tube 12 to the feed tube exit 13 where it is fed into another assembly 14 for additional processing such as a tensioner 15 coupled with winder 16. Although a tensioner and winder are illustrated here for the purposes of discussion, the type of additional processing is not generally limited in scope and may include one or more operations such as roving, rewinding, braiding, twisting, weaving, plying, knitting, chopping, pultrusion, filament winding, prepregging, wire coating or cabling, tensioning or beaming or other processes requiring or benefiting from a linear high-speed fiber feed.

The intake housing 7 preferably provides a solid, smooth and durable surface that does not tend to damage or fuzz the fiber and does not suffer undue damage as the fiber is drawn across it at high speeds. Materials such as polished stainless steel, copper and brass have been found to be acceptable for constructing the dampening bars, intake housing and feed tubes for use with glass fibers. Other materials including metals such as chromed or nickeled steel, alloys, composite materials, ceramics, Teflon® or other high molecular weight polymers could also be used singly or in combination in constructing these elements. The key consideration in the selection of an appropriate material is that they wear smoothly and consistently without producing sharp or rough areas that could tend to damage the fiber as it is drawn across the worn surface. For this reason, black iron, uncoated steel and ceramics having a high iron content are generally not preferred for use in combination with glass fibers.

As will be appreciated, the selection of the materials and the sizing of the elements will be selected with regard to the type and size of the fiber being fed through the assembly and the rate at which the fiber will be fed to provide fiber/surface contact conditions that do not result in damage to the fiber or the surface.

Figure 2:
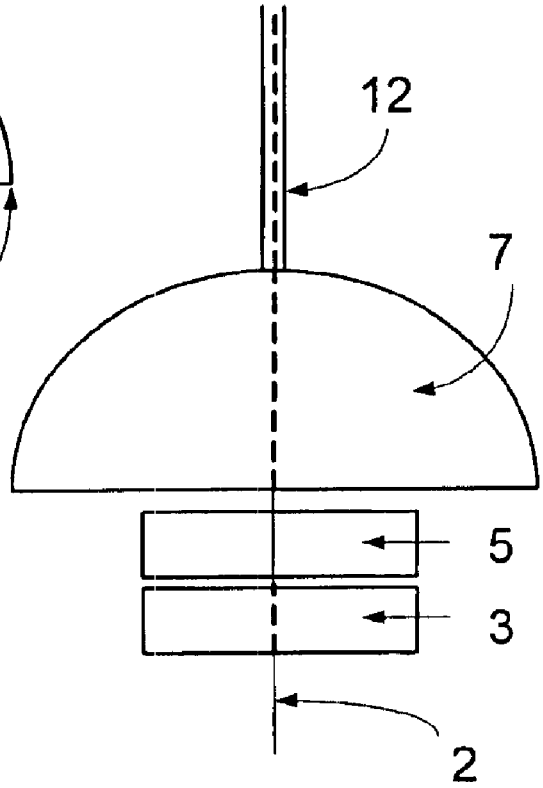
FIG. 2 illustrates a portion of the apparatus shown in FIG. 1 rotated 90°.

As illustrated in FIGS. 1 and 2, a preferred embodiment of the present invention comprises a pair of generally parallel and closely spaced cylindrical dampening bars 3, 5 through which the fiber 2 is drawn in a serpentine pattern. As illustrated in FIGS. 3A–F, however, the present invention may employ various configurations of the basic mechanical elements.

In the embodiment illustrated in FIG. 1, the centers of the dampening bars are generally aligned along a fiber axis 2' defined between the fiber source 1 and the center of the rear opening 11 into feed tube 12. This fiber axis does not necessarily reflect the actual path of the fiber 2 between the fiber source 1 and the feed tube 12, but rather provides a reference point for the relative positioning of certain elements of the present invention.

Figure 3A:
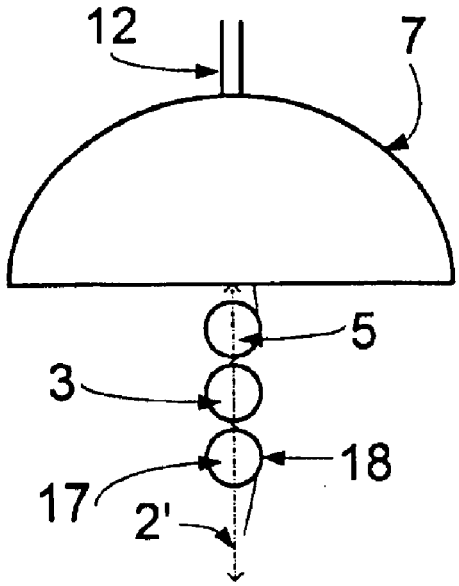
FIGS. 3A–F illustrate various embodiments of the claimed apparatus with alternate configurations of the dampening bar assembly.

In the embodiment illustrated in FIG. 3A, a third dampening bar 17 having a bearing surface 18 is provided below dampening bars 3, 5 is increase the length of the serpentine path taken by fiber 2 between the fiber source and the intake housing 7. The spacing between adjacent dampening bars can be the same or the spacing between the lower dampening bars 3, 17 can be somewhat larger for knocking down large loops without binding.

Figure 3B:
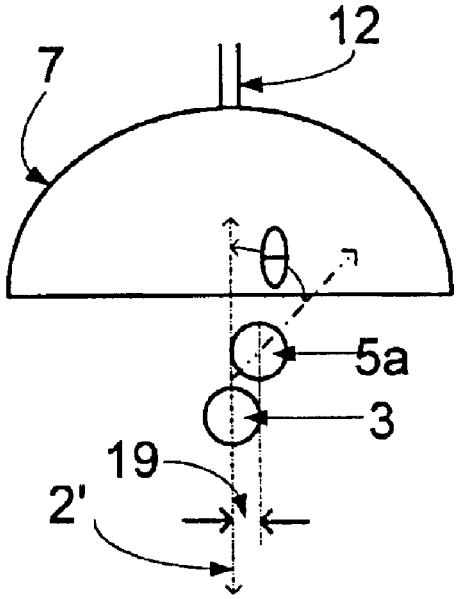

In the embodiment illustrated in FIG. 3B, one of the dampening bars 5*a* is fixed in a position offset from the fiber axis 2' by an offset distance 19 to modify the path taken by the path taken by the fiber 2, the length and location of the surface portions of the dampening bars contacted by the fiber and the tension exerted on or applied to the fiber. Although, as illustrated, only the upper dampening bar is offset, it is contemplated that one or more of the dampening bars present in a particular embodiment could be offset from the fiber axis 2'. The offset distances may be to either side of the fiber axis and may, if more than one dampening bar is offset, have different magnitudes to adapt the assembly to the particular application. One measure of the dampening bar offset is the offset angle θ measured between the fiber axis 2' and a line projected through the center of the dampening bar and a point on the fiber axis 2' perpendicular to the lowest surface of the dampening bar.

Figure 3C:
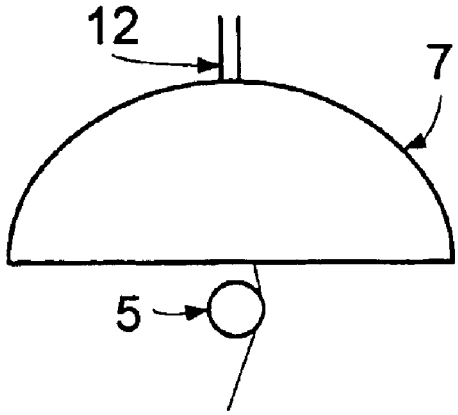

In the embodiment illustrated in FIG. 3C, only a single dampening bar is employed. Although this is not the preferred configuration, it is contemplated that in some applications, a single dampening bar would be sufficient to control the fiber feed into the intake housing.

Figure 3D:
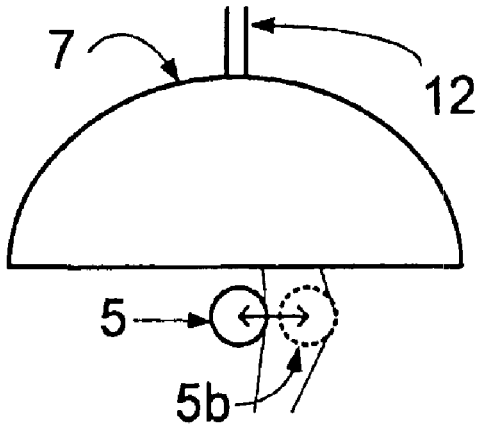

In the embodiment illustrated in FIG. 3D, at least one of the dampening bars (dampening bar 5 used for convenience only) in the fiber feed assembly may be mounted so as to be moveable between at least a first position 5 and a second position 5*a* to provide additional control over the path tension of the fiber 2 entering the intake housing 7. The movement of the moveable dampening bar(s) can be generally linear (generally horizontal linear motion illustrated), arcuate or, in the case of non-cylindrical dampening bars, rotational, or a combination of two or more types of motion. Further, if more than one dampening bar is moveable, the movements of the respective moveable dampening bars may be coordinated or independent using a variety of known mechanisms.

Figure 3E:
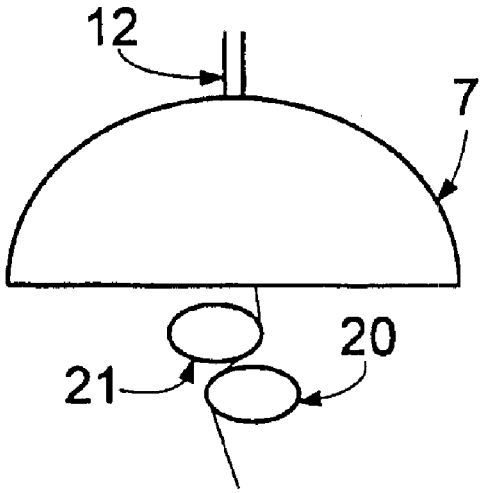

In the embodiment illustrated in FIG. 3E, alternative configurations of the dampening bars 20, 21 may be employed including oval shapes or even more irregular shapes (not illustrated) in which only the portion of the dampening bars actually contacted by the fiber 2 are smooth and durable.

Figure 3F:
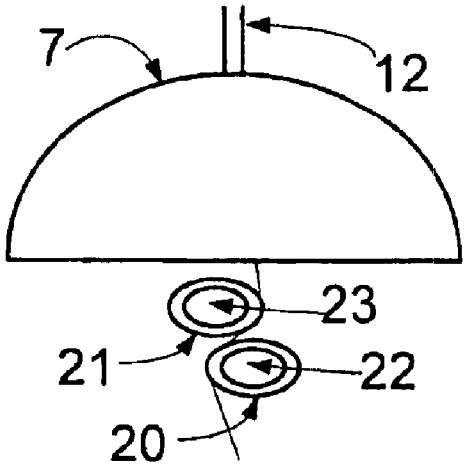

As illustrated in FIG. 3F, one or more of the dampening bars may be hollow, either simply to reduce the overall weight of the system or to provide a passage 22, 23 through which a fluid could be passed to heat or cool the dampening bar as desired.

Figure 4:
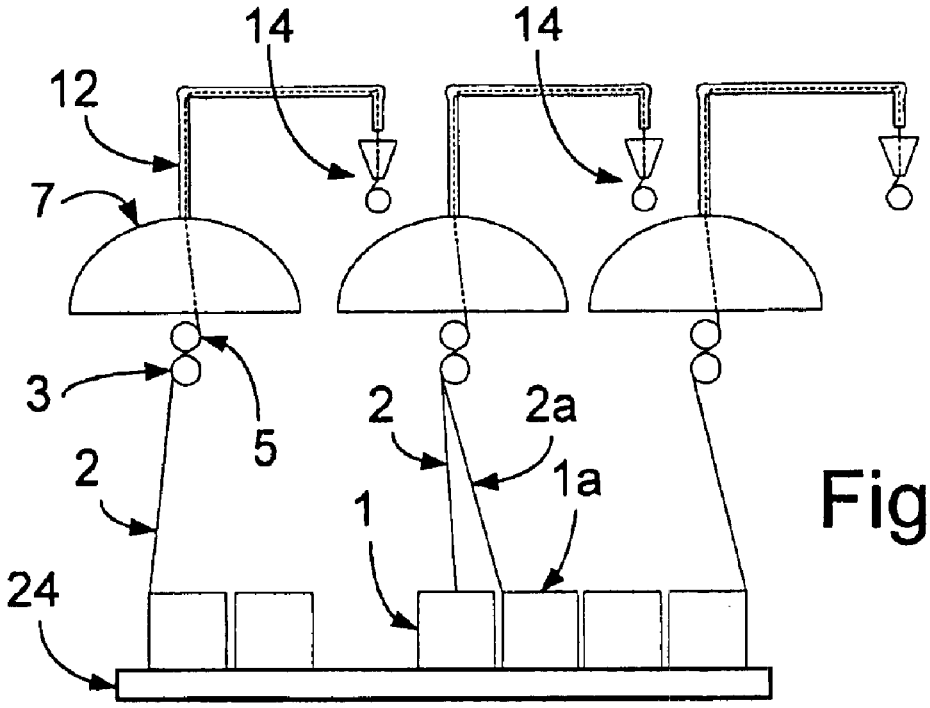
FIG. 4 illustrates an embodiment of the claimed apparatus configured to receive fiber from a plurality of fiber sources that may be arranged on a pallet or in a creel.
Figure 5:
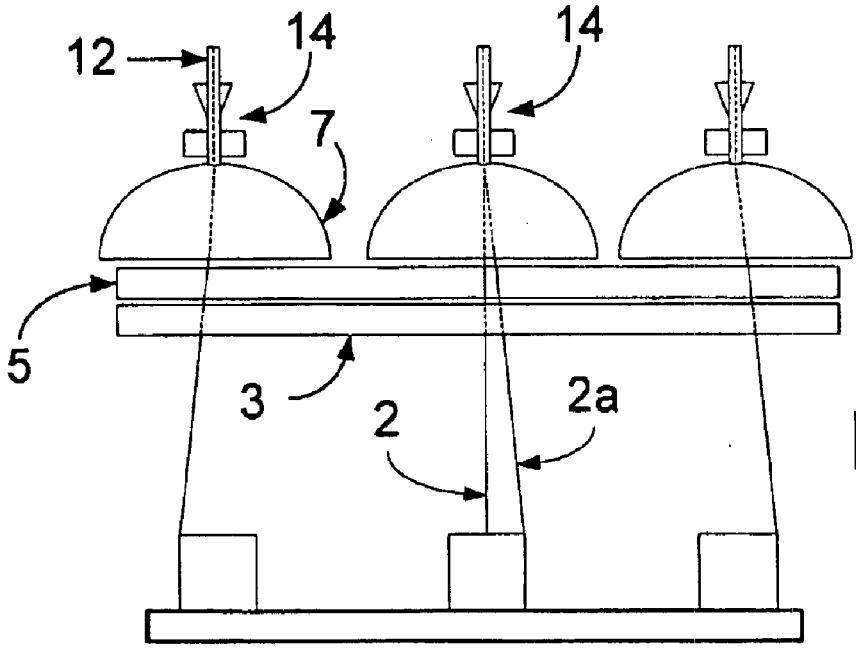
FIG. 5 illustrates a portion of the apparatus shown in FIG. 4 rotated 90°.

As illustrated in FIGS. 4 and 5, in a preferred embodiment of the invention, a plurality of fiber feed assemblies may arranged adjacent one another to draw a plurality of fibers 2 from a plurality of fiber sources 1 arranged on a pallet or creel 24. Although in the preferred embodiment each feed assembly draws fiber from only one fiber source at a time, for certain applications it may be desirable to feed a plurality of fibers through a single fiber feed assembly. As illustrated in FIGS. 4 and 5, the middle of the three fiber feed assemblies simultaneously draws two fibers 2, 2*a* from corresponding fiber sources 1, 1*a* and delivers them together to a single additional processing assembly 14. Further, although FIG. 5 shows the use of common dampening bars 3, 5, each of the individual feed assemblies could be configured with dedicated dampening bars. In instances where one or more of the dampening bars is moveable, as illustrated in FIG. 3D, independent dampening bars would be preferred.

Figure 6:
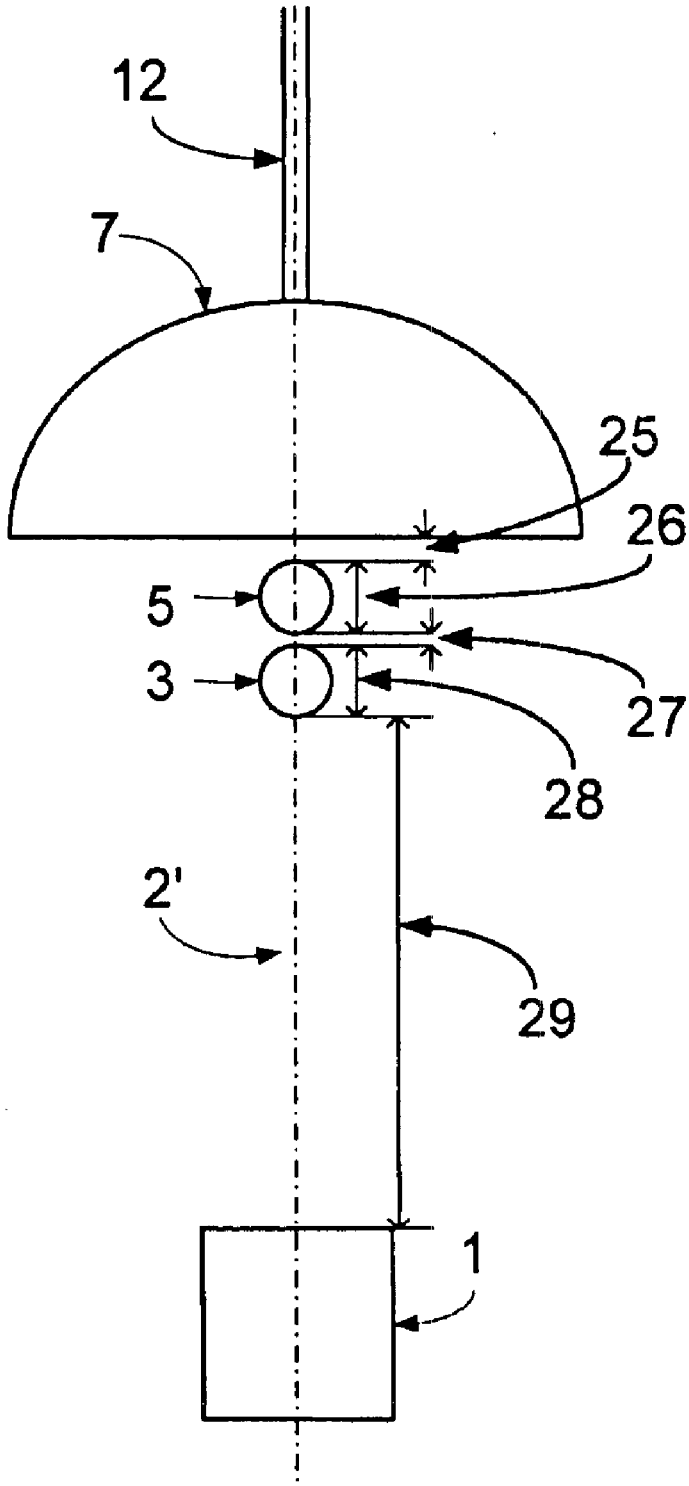
FIG. 6 illustrates certain of the mechanical components of the apparatus illustrated in FIG. 1 with additional markings to highlight certain spacings and dimensions of the apparatus.

As illustrated in FIG. 6, feed assemblies according to the present invention are characterized by certain spacings between and sizings of the various components that are indicated on a portion of the embodiment illustrated in FIG. 1. The indicated dimensions include a distance 25 between the upper dampening bar 5 and the intake housing 7, a distance 27 between the upper dampening bar 5 and a lower dampening bar 3, and, in the illustrated twin dampening bar configuration, a distance 29 between the lower dampening bar 3 and the fiber source 1.

In addition to the indicated spacings, sizings such as the diameter of the upper dampening bar 26, the diameter of the lower dampening bar 28, the diameter and depth of the intake housing, the dimensions of the fiber, and the diameter of the feed tube also require consideration in the construction of a fiber feed assembly for a particular application. As will be appreciated, other embodiments such as illustrated in FIG. 3A may have additional spacings and sizings, while other embodiments such as illustrated in FIG. 3C may have fewer spacings and sizings to be considered.

When more than one dampening bar is used, it is preferred that the spacing 27 between at least the first two dampening bars contacted by the fiber be maintained at some low multiple of the maximum fiber dimension, typically less than 5, to assist in knocking down and removing loops that may be drawn from the fiber package before the fiber enters the intake housing. Similarly, it is preferred that that distance 25 between the upper dampening bar 5 and the intake housing 7 also be maintained at some low multiple of the maximum fiber diameter, typically less than 15, to provide good control of the fiber entering the intake housing.

With respect to the spacing 29 between the lower dampening bar 3 and the fiber source 1, however, it is preferred that this distance be considerably larger, typically at least 50 times and preferably at least about 100 times the spacing between the dampening bars so that variations in the point on the fiber source 1 from which the fiber is being drawn have a reduced impact on the angle of the fiber as it contacts the first dampening bar. Similarly with respect to the sizing of the intake housing 7, it is preferred that the wider opening 8 be at least about 50 larger, and preferably at least about 100 times larger, than the largest fiber dimension. With respect to the sizing of the feed tube 12, it is preferred that its diameter be at least about 5 times larger, and preferably at least about 10 times larger, than the largest fiber dimension. As indicated in the Example below, a fiber feed assembly with component spacings and sizings within the more preferred range performed very well at high feed rates.

In general, the use of thicker fibers, fibers with higher levels of twist, stiffer fibers, and/or higher feed rates will require an increase in the minimum fiber source to lower dampening bar separation distance ($D_{SDB}$) in order for the feed assembly to perform in a satisfactory manner. Conversely, when feeding thinner fibers, fibers with lower levels of twist or no twist, more flexible fibers, softer fibers and/or using slower feed rates the $D_{SDB}$ can be reduced while maintaining satisfactory performance. In evaluating the sufficiency of the $D_{SDB}$ and the effect of the dampening bars, no loops or surges of fiber should make it through the intake housing and into the feed tube. If such conditions are observed, corrective action can encompass additional dampening in the dampening bar assembly, increased $D_{SDB}$ or a combination of the these adjustments. Generally, increased $D_{SDB}$ is preferred in situations where minimizing the potential for damaging the fiber is the goal. If space constraints make increasing the $D_{SDB}$ difficult and/or if some damage to the fiber can be tolerated, increasing the degree of contact between the fiber and the dampening bars can be used to improve the linearity of the fiber feed.

Figure 7:
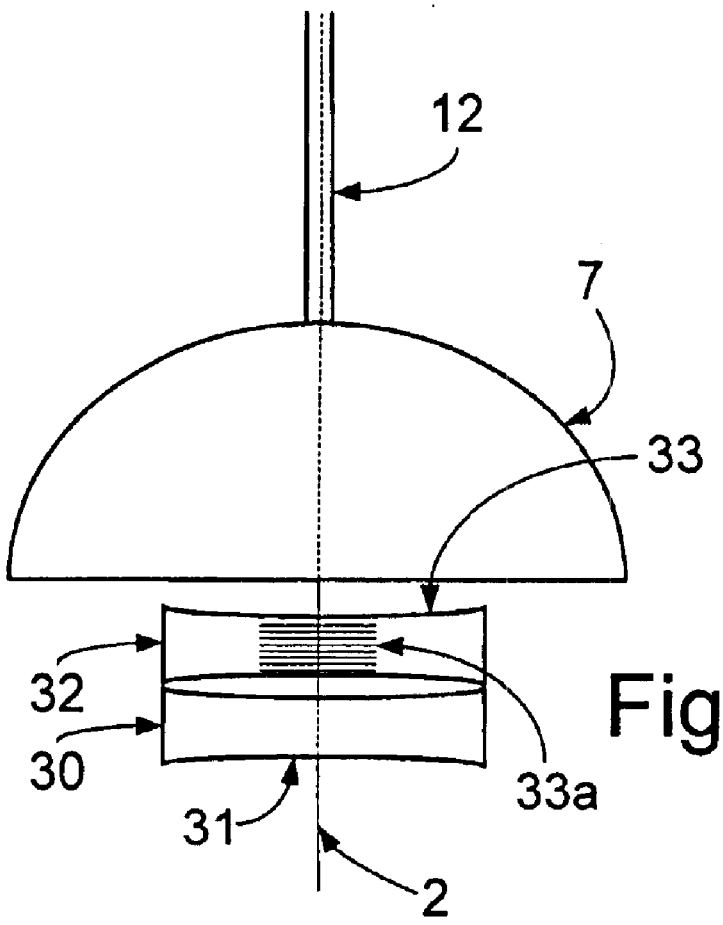
FIG. 7 illustrates an embodiment of the claimed apparatus shown in FIG. 2 that incorporates modified dampening bars.

As illustrated in FIG. 7, in another alternative configuration of the present invention the surface of the dampening bars 30, 32 may be provided with concave surface portions 31, 33 to assist in centering and guiding the fiber 2 across the surfaces of the dampening bars. Further, although smooth durable surfaces are preferred for the bearing surfaces, the contacted surface or a portion of the contacted surfaces 33*a* on one or more of the dampening bars may be textured so that the condition of the fiber 2 will be altered, typically roughened or frayed in some manner, as it is drawn across the surface of the dampening bar.

Figure 8:
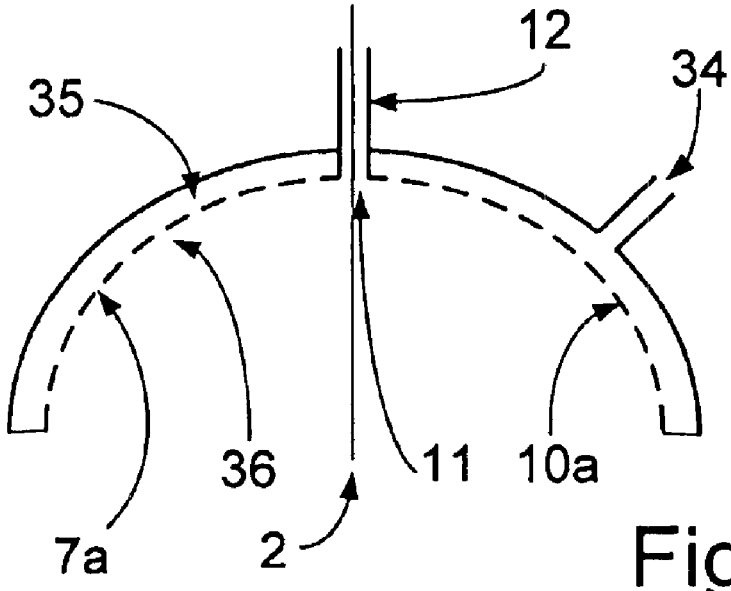
FIG. 8 illustrates an alternative embodiment of an intake housing for use in the claimed apparatus.

As illustrated in FIG. 8, an alternative embodiment of the present invention incorporates one or more gas inlets 34 through which a gas, such as air, steam, oxygen, helium or nitrogen, could be introduced into one or more passages 35 and through a plurality of perforations 36 or other openings, nozzles, or inlets through the intake housing 7*a*. By adjusting the rate at which gas exits through the perforations 36, contact between the fiber 2 and the inner surface 10*a* of the intake housing can be reduced. Similarly, by selecting the appropriate gas this embodiment can help control temperature, humidity, moisture content or accumulation of static charges as the fiber 2 is drawn though the intake housing 7*a* and feed tube 12. Similarly, by selecting other gases or changing the properties of the gas(es), this embodiment may be used to at least partially pre-condition the fiber 2 for subsequent processing as the fiber is drawn through the intake housing 7*a* and feed tube 12.

Figure 9A:
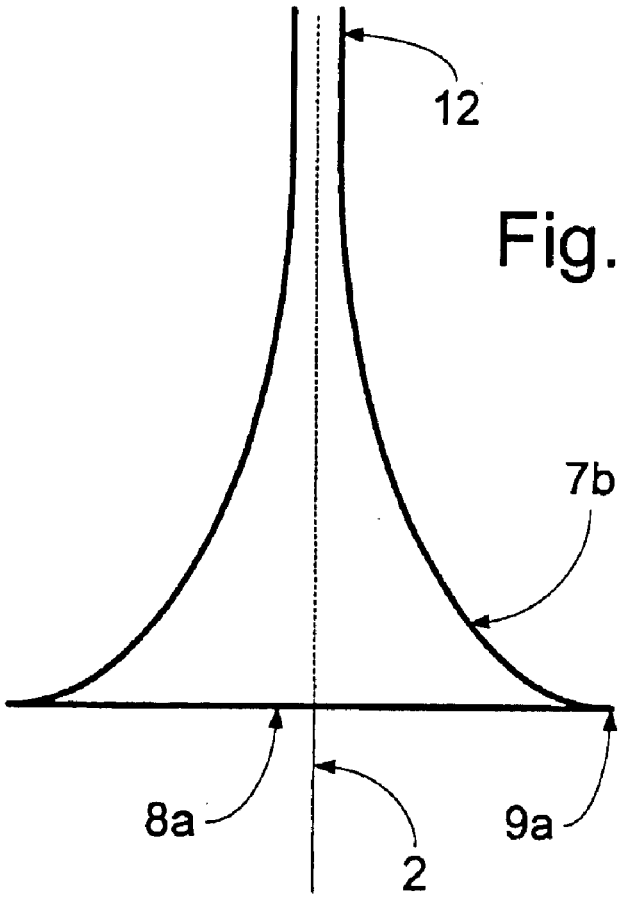
FIGS. 9A–B illustrate alternate configurations for the intake housing for use in the claimed apparatus.
Figure 9B:
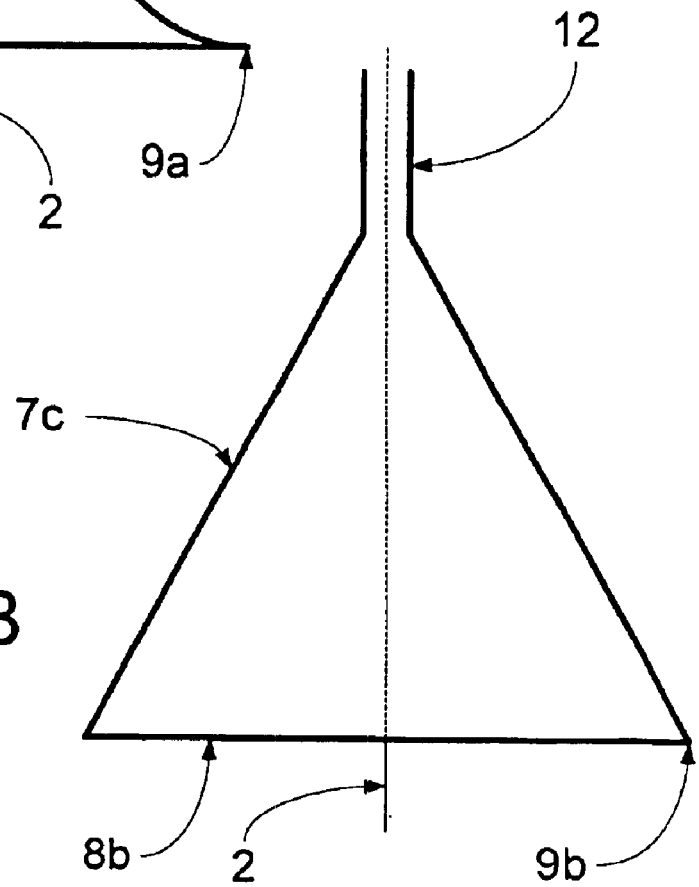

In addition to the generally hemispherical housings illustrated in FIGS. 1–8, both fluted intake housings 7*b*, FIG. 9A, and conical intake housings 7*c*, FIG. 9B, could be incorporated into a fiber feed assembly according to the present invention. Further, any of the solid intake housings 7, 7*b*, 7*c* could be modified along the lines illustrated in FIG. 8 to permit the introduction of one or more gases through the sides of the intake housing. Regardless of the intake housing configuration selected, it must be sized and configured to provide sufficient control of the fiber by constricting its range of motion while minimizing unnecessary contact with the interior surface of the intake housing. In testing, both hemispherical (domed) and conical (tapered) intake housings of sufficient size performed well.

COMPARATIVE EXAMPLE

The original fiber feed apparatus was configured to draw a series of 600–1470 tex (grams/kilometer) glass fibers (generally oval with approximate dimensions of 0.26 mm×2.18 mm) from a collection of windings arranged on a pallet and pass the fibers through a series of open ring guides and into a feed tube inlet of a feed tube constructed from ¾ inch (1.9 cm) copper tubing. A spring tensioning device was positioned adjacent the outlet of the feed tube to apply a uniform tension to the fiber exiting the feed tube before passing the fiber to a winding operation. With the prior art open ring design, operation of the fiber feed apparatus at feed rates above 200 meters/min tended to result in the fiber wrapping around a portion of the guide ring or its supporting members and breaking or halting the operation.

EXAMPLE

The original fiber feed apparatus was modified so that the identical glass fiber was drawn from an identical arrangement of windings again arranged on a pallet. According to the invention, however, the glass fiber first passed along a serpentine path through a two-bar dampening bar assembly of 1½ inch (38.1 mm) diameter copper pipes spaced approximately ¼ inch (6.3 mm) apart. The lower dampening bar was positioned at least about 24 inches (61 cm) above the pallet and the upper dampening bar was generally centered approximately ¼ inch (6.3 mm) below a hemispherical stainless steel funnel with a radius of approximately 7½ inches (19 cm) and a smooth interior surface. The stainless steel funnel included a small rear exit through which the fiber was fed into a feed tube constructed from ¾ inch (1.9 cm) copper tubing. With the fiber feed assembly modified in accord with the present invention, it was possible to feed the identical glass fiber from identical packages into the identical spring tensioning device and winding operation at rates in excess of 1500 meters/min without fiber wrapping or binding. This more than sevenfold increase in the sustainable fiber feed rate produced a dramatic productivity improvement over the prior art fiber feed apparatus while simultaneously increasing operator safety.

The description and illustrations of the present invention provided above are merely exemplary in nature and it is anticipated that those of ordinary skill in the art will appreciate that many variations of the specific apparatus described are possible without departing from the spirit and scope of the invention.

What we claim is:

1. A fiber feed system comprising:

a fiber source from which a fiber is drawn;

a dampening bar assembly having a surface portion for receiving and contacting the fiber being drawn from the fiber source;

an intake housing arranged to receive the fiber from the dampening bar assembly, the intake housing providing a large front opening through which the fiber enters the intake housing and a small rear opening through which the fiber exits the intake housing;

a feed tube having an inlet arranged adjacent the rear opening of the intake housing to receive the exiting fiber and an outlet; and a fiber processing apparatus to receive and process the fiber exiting from the feed tube outlet; wherein, the dampening bar assembly comprises a first dampening bar and a second dampening bar, each of the dampening bars being generally cylindrical and characterized by a longitudinal axis and a diameter, the first and second dampening bars being arranged so that their longitudinal axes are both substantially parallel to one another and perpendicular to the fiber being drawn from the fiber source, the fiber making contact with both a first rounded outer surface on the first dampening bar and with a second rounded outer surface on the second dampening bar before entering the intake housing.

2. A fiber feed system according to claim 1, wherein the intake housing comprises a generally hemispherical assembly with an edge of the front opening generally defining a circle in proximity to the second dampening bar, the intake housing and the second dampening bar being arranged so that a diameter of the front opening is generally above and parallel to the longitudinal axis of the second dampening bar.

3. A fiber feed system according to claim 2, wherein the portions of the intake housing and dampening bar assembly contacted by the fiber comprise a plurality of smooth bearing surfaces that cause little or no damage to the fiber as it passes over the bearing surfaces.

4. A fiber feed system according to claim 3, wherein the portions of the intake housing and dampening bar assembly contacted by the fiber comprise one or more materials selected from a group consisting of stainless steel, copper, high density polymers, and ultra high molecular weight polymers.

5. A fiber feed system according to claim 3, wherein the small rear opening of the intake housing and the feed tube inlet are configured to provide a smooth rounded transition surface between the intake housing and the feed tube.

6. A fiber feed system according to claim 2, wherein at least one portion of one of the dampening bars contacted by the fiber is provided with a textured surface sufficient to alter the fiber in a predetermined manner as the fiber passes over the textured surface.

7. A fiber feed system according to claim 1, wherein the relative positions of the fiber source and the rear opening of the intake housing define a fiber axis, and the longitudinal axes of the first and second dampening bars are generally perpendicular to the fiber axis.

8. A fiber feed system according to claim 7, wherein the longitudinal axes of the first and second dampening bars generally intersect the fiber axis.

9. A fiber feed system according to claim 7, wherein the longitudinal axis of one of at least one of the first and second dampening bars is offset from the fiber axis, a line between the two longitudinal axes forming an offset angle with the fiber axis.

10. A fiber feed system according to claim 9, wherein the offset angle is at least 15 degrees.

11. A fiber feed system according to claim 7, wherein at least one of the first and second dampening bars is moveable between a first position and a second position with respect to the fiber axis, the movement tending to modify a tension exerted on the fiber as it is drawn into the intake housing.

12. A fiber feed system according to claim 1, wherein at least one of the first dampening bar and the second dampening bar is moveable between a first radial spacing and a second radial spacing with respect to a fiber axis, the movement tending to modify a tension exerted on the fiber as it is drawn into the intake housing.

13. A fiber feed system comprising:

a plurality of fiber sources fro which a plurality of fibers are drawn;

a dampening bar assembly having a plurality of rounded surface portions across which the fibers are drawn from the fiber sources;

a plurality of intake housings arranged to receive one or more of the fibers from the dampening bar assembly, each intake housing providing a large front opening through which one or more fibers enters the intake housing and a small rear opening though which the one or more fibers exits the intake housing;

a plurality of fee tubes, each feed tube having an inlet arranged at the rare opening of one of the intake housings to receive the exiting fiber or fibers and an outlet; and a fiber processing apparatus arranged to receive the fiber or fibers exiting from one or more of the feed tube outlets; wherein, the plurality of fiber sources are arranged in a creel that holds the fiber sources in a predetermined orientation with respect to the intake housings;

the fiber sources, dampening bar assembly and intake housing are arranged in a generally vertically aligned orientation wherein the fiber sources are arranged generally below the dampening bar assembly and the dampening bar assembly is arranged generally below the intake housing;

and further wherein, a first ratio between a first distance between the fibers sources and the dampening bar assembly and a second distance between the dampening bar assembly and the intake housing is at least 10.

14. A fiber feed system according to claim 13 wherein the first ratio is at least 25.

15. A fiber feed system according to claim 13 wherein the first ratio is at least 50.

16. A fiber feed system according to claim 13 wherein the dampening bar assembly comprises a first and a second dampening bar; and further wherein;

a second ratio of a third distance between the first and second dampening bars and a second distance between one of the first and second dampening bars closest to the intake housing and the intake housing is less than about 5.

17. A fiber feed system according to claim 16 wherein:

the second ratio is less than about 2.

18. A fiber feed system comprising:

a fiber source from which a fiber is drawn;

a dampening bar assembly including at least a first dampening bar, the first dampening bar defining an elongate member between a first terminal end and a second terminal end and being generally cylindrical and characterized by a longitudinal axis, the first dampening bar having at least a portion of a first outer surface configured to receive and to contact the fiber being drawn from the fiber source;

an intake housing arranged to receive the fiber from the first dampening bar, the intake housing providing a front opening through which the fiber enters the intake housing and a rear opening through which the fiber exits the intake housing; and a feed tube having an inlet arranged adjacent the rear opening of the intake housing to receive the exiting fiber and an outlet.

19. The system of claim 18 wherein the first dampening bar is disposed such that a center of the first dampening bar is generally aligned along a fiber axis of the fiber defined between the fiber source and a center of the rear opening of the intake housing.

20. The system of claim 19 wherein the first dampening bar is further disposed such that it is moveable between at least a first position where the center of the first dampening bar is generally aligned along the fiber axis of the fiber and at least a second position where the first dampening bar is offset from the fiber axis of the fiber.

21. The system of claim 18 wherein the dampening bar assembly further includes a second dampening bar defining an elongate member between a first terminal end and a second terminal end and being generally cylindrical and characterized by a longitudinal axis, the second dampening bar having at least a portion of a first outer surface configured to receive and to contact the fiber being drawn from the fiber source, the second dampening bar being disposed relative to the first dampening bar such that the first and the second dampening bars define a first distance therebetween through which the fiber is drawn.

22. The system of claim 21 wherein the second dampening bar is disposed relative to the first dampening bar such that the longitudinal axes of the first and the second dampening bars are substantially parallel.

23. The system of claim 22 wherein the first dampening bar and the second dampening bar are disposed such that a center of each of the first and the second dampening bar is generally aligned along a fiber axis of the fiber defined between the fiber source and a center of the rear opening of the intake housing.

24. The system of claim 23 wherein one of the first dampening bar and the second dampening bar is moveable between at least a first position where the center of one of the first dampening bar and the second dampening bar is generally aligned along the fiber axis of the fiber and at least a second position where the center of one of the first dampening bar and the second dampening bar is offset from the fiber axis of the fiber.

25. The system of claim 21 wherein the second dampening bar is disposed relative to the first dampening bar such that the longitudinal axis of the first dampening bar is offset relative to the longitudinal axis of the second dampening bar.

26. The system of claim 25 wherein one of the first dampening bar and the second dampening bar is further disposed such that a center of one of the first dampening bar and the second dampening bar is generally aligned along a fiber axis of the fiber defined between the fiber source and a center of the rear opening of the intake housing.

27. The system of claim 25 wherein one of the first dampening bar and the second dampening bar is moveable to modify the first distance between the first dampening bar and the second dampening bar.

28. The system of claim 27 wherein each of the first dampening bar and the second dampening bar are disposed to exert a tension on the fiber as it is drawn into the intake housing.

29. The system of claim 21 wherein the first dampening bar is offset at an angle relative to the second dampening bar.

30. The system of claim 29 wherein the second dampening bar is generally aligned along a fiber axis of the fiber defined between the fiber source and a center of the rear opening of the intake housing.

31. The system of claim 30 wherein the angle measures between the fiber axis and a line projected through the center of the first dampening bar and a point along the fiber axis perpendicular to a lowest surface of the first dampening bar.

32. The system of claim 31 wherein the angle is at least 15 degrees.

33. The system of claim 21 wherein a first ratio between a second distance between the fiber source and the dampening bar assembly and a third distance between the dampening bar assembly and the intake housing is at least 50.

34. The system of claim 33 wherein a second ratio between the first distance between the first and the second dampening bars and the third distance between the dampening bar assembly and the intake housing is less than about 5.

35. The system of claim 34 wherein the second ratio is less than about 2.

36. The system of claim 21 wherein the first ratio is at least 25.

37. The system of claim 21 wherein the first ratio is at least 10.

38. The system of claim 21 wherein each of the first and the second dampening bars is one of a circular cylinder and an oval cylinder.

39. The system of claim 21 wherein each of the first and the second dampening bars is a hollow member.

40. The system of claim 18 wherein the first dampening bar is one of a circular cylinder and an oval cylinder.

41. The system of claim 18 wherein the first dampening bar is a hollow member.

42. The system of claim 18 further comprising a fiber processing system to receive and process the fiber exiting from the feed tube outlet.

* * * * *

UNITED STATES PATENT AND TRADEMARK OFFICE

CERTIFICATE OF CORRECTION

PATENT NO. : 6,869,004 B2
DATED : March 22, 2005
INVENTOR(S) : James R. Priest et al.

It is certified that error appears in the above-identified patent and that said Letters Patent is hereby corrected as shown below:

Column 9,
Line 22, the word “fro” should read -- for --.
Line 33, the word “fee” should read -- feed --.

Signed and Sealed this

Thirtieth Day of August, 2005

JON W. DUDAS
*Director of the United States Patent and Trademark Office*